US012692573B2

(12) United States Patent
Hong

(10) Patent No.: US 12,692,573 B2
(45) Date of Patent: Jul. 28, 2026

(54) STEEL PLATE FOR PRESSURE VESSEL WITH EXCELLENT CRYOGENIC TOUGHNESS, AND METHOD OF MANUFACTURING SAME

(71) Applicant: POSCO CO., LTD, Pohang-si (KR)

(72) Inventor: Soon-Taik Hong, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 420 days.

(21) Appl. No.: 18/265,122

(22) PCT Filed: Nov. 22, 2021

(86) PCT No.: PCT/KR2021/017164
§ 371 (c)(1),
(2) Date: Jun. 2, 2023

(87) PCT Pub. No.: WO2022/124633
PCT Pub. Date: Jun. 16, 2022

(65) Prior Publication Data

US 2024/0002970 A1 Jan. 4, 2024

(30) Foreign Application Priority Data

Dec. 10, 2020 (KR) ..... 10-2020-0172049

(51) Int. Cl.

| | |
|---|---|
| ***C21D 9/46*** | (2006.01) |
| ***C21D 1/18*** | (2006.01) |
| ***C21D 1/60*** | (2006.01) |
| ***C21D 1/84*** | (2006.01) |
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |

(52) U.S. Cl.
CPC ..... *C21D 9/46* (2013.01); *C21D 1/18* (2013.01); *C21D 1/60* (2013.01); *C21D 1/84* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/44* (2013.01); *C21D 2211/001* (2013.01); *C21D 2211/002* (2013.01); *C21D 2211/008* (2013.01)

(58) Field of Classification Search
CPC ... C21D 9/46; C21D 1/18; C21D 1/60; C21D 1/84; C21D 6/004; C21D 6/005; C21D 6/008; C21D 8/0205; C21D 8/0226; C21D 8/0263; C21D 2211/001; C21D 2211/002; C21D 2211/008; C21D 1/26; C21D 1/28; C21D 6/001; C21D 1/56; C22C 38/002; C22C 38/02; C22C 38/04; C22C 38/06; C22C 38/44; C22C 38/08; C22C 38/12; C22C 38/01
USPC ..... 148/500
See application file for complete search history.

(56) References Cited

U.S. PATENT DOCUMENTS

| | | | | |
|---|---|---|---|---|
| 6,159,312 | A * | 12/2000 | Koo | C21D 8/0226 148/648 |
| 2015/0147222 | A1 | 5/2015 | Miura et al. | |
| 2020/0283877 | A1 | 9/2020 | Lee | |
| 2022/0290266 | A1 | 9/2022 | Hong | |

FOREIGN PATENT DOCUMENTS

| | | | |
|---|---|---|---|
| CN | 104451407 | A | 3/2015 |
| CN | 110088332 | A | 8/2019 |
| EP | 2987885 | A1 | 2/2016 |
| EP | 3550049 | A1 | 10/2019 |
| EP | 3712291 | A1 | 9/2020 |
| EP | 3 559 298 | B1 | 1/2024 |

(Continued)

OTHER PUBLICATIONS

Yuga Masao et.al. [JP2015086403A] (machine translation) (Year: 2015).*
WO2015064045A1 (machine translation). (Year: 2015).*
Seo in Suk [KR20040054198A] (machine translation) (Year: 2004).*
International Search Report for PCT/KR2021/017164 dated Mar. 11, 2022.
Communication dated Jul. 30, 2024 issued by the Japanese Patent Office in application No. 2023-535047.
Extended European Search Report dated Jun. 30, 2025, issued in European application No. 21903679.5.
Communication dated Mar. 24, 2026, in Chinese Application No. 202180082475.8.

*Primary Examiner* — Sally A Merkling
*Assistant Examiner* — Nazmun Nahar Shams
(74) *Attorney, Agent, or Firm* — Sughrue Mion, PLLC

(57) ABSTRACT

The present invention relates to a method of manufacturing a cryogenic steel plate for a pressure vessel and a cryogenic steel plate for a pressure vessel manufactured thereby, the method comprising the steps of: reheating a slab containing, in weight %, C: 0.05-0.15%, Si: 0.20-0.35%, Mn: 0.5-1.5%, P: 0.012% or less, S: 0.015% or less, Al: 0.02-0.10%, Ni: 6.01-6.49%, Mo: 0.2-0.4%, Cr: and the balance being Fe and inevitable impurities; hot-rolling the reheated steel plate, followed by air cooling; subjecting the air-cooled steel plate to primary heat treatment at 800-880° C. for (2.4×t+(10–40)) minutes (t: slab thickness (mm)), followed by primary water cooling: subjecting the primarily water-cooled steel plate to secondary heat treatment at 700-780° C. for (2.4×t+(10–40)) minutes (t: slab thickness (mm)), followed by secondary water cooling: and tempering the secondarily water-cooled steel plate.

2 Claims, No Drawings

(56) References Cited

FOREIGN PATENT DOCUMENTS

| | | | | | |
|---|---|---|---|---|---|
| JP | 07-109544 | A | | 4/1995 | |
| JP | 2014-210948 | A | | 11/2014 | |
| JP | 2015-86403 | A | | 5/2015 | |
| JP | 2016-183387 | A | | 10/2016 | |
| JP | 2019-81929 | A | | 5/2019 | |
| JP | 2021-503552 | A | | 2/2021 | |
| JP | 2022-547465 | A | | 11/2022 | |
| KR | 10-2004-0054198 | A | | 6/2004 | |
| KR | 20040054198 | A | * | 6/2004 | ..... C21D 8/0252 |
| KR | 10-2012-0011289 | A | | 2/2012 | |
| KR | 10-2015-0023724 | A | | 3/2015 | |
| KR | 10-2016-0033209 | A | | 3/2016 | |
| KR | 10-2016-0078675 | A | | 7/2016 | |
| KR | 10-2075206 | B1 | | 2/2020 | |
| WO | WO-2015064045 | A1 | * | 5/2015 | ..... C21D 8/0263 |
| WO | 2019/239761 | A1 | | 12/2019 | |

* cited by examiner

STEEL PLATE FOR PRESSURE VESSEL WITH EXCELLENT CRYOGENIC TOUGHNESS, AND METHOD OF MANUFACTURING SAME

This Application is a National Stage of International Application No. PCT/KR2021/017164 filed Nov. 22, 2021, claiming priority based on Korean Patent Application No. 10-2020-0172049 filed Dec. 10, 2020, the entire disclosures of which are incorporated herein by reference.

TECHNICAL FIELD

The present disclosure relates to a steel plate for pressure vessel with excellent cryogenic toughness and a manufacturing method thereof.

BACKGROUND ART

Since a low-temperature high-strength thick plate steel material needs to be able to be used as a cryogenic structural material during construction, the low-temperature high-strength thick plate steel material is required to have high-strength and cryogenic toughness characteristics.

High-strength hot-rolled steel produced through normalizing treatment has a mixed structure of ferrite and pearlite, and an example of the related art for the high-strength hot-rolled steel may include the invention described in Korean Patent Laid-Open Publication No. 2012-0011289.

The Korean Patent Laid-Open Publication No. 2012-0011289 proposes 500 MPa class high-strength steel for LPG composed of, in weight %, 0.08 to 0.15% of C, 0.2 to 0.3% of Si, 0.5 to 1.2% of Mn, 0.01 to 0.02% of P, 0.004 to 0.006% of S, Ti more than 0% and 0.01% or less, 0.05 to 0.1% of Mo, 3.0 to 5.0% of Ni, and the remainder of Fe, and other inevitable impurities, in which Ni and Mo are added in the steel composition.

However, since the invention described in the Korean Patent Laid-Open Publication No. 2012-0011289 is steel manufactured through the typical normalizing treatment, there may be a problem that the cryogenic lateral expansion characteristics of the steel materials are not sufficient even if Ni is added.

Accordingly, there is a demand for the development of steel materials having excellent cryogenic impact toughness and improved cryogenic lateral expansion characteristics.

RELATED ART DOCUMENT (Patent Document 0001) Korean Patent Laid-Open Publication No. 2012-0011289 (Feb. 7, 2012)

DISCLOSURE

Technical Problem

The present disclosure provides a steel plate for a cryogenic pressure vessel with high strength and excellent cryogenic toughness and a method of manufacturing the same.

More specifically, the present disclosure provides a steel plate for a cryogenic pressure vessel with strength and lateral expansion characteristics that may be stably used at a cryogenic temperature of −150° C. or lower, while securing a tensile strength of 750 MPa, and a method of manufacturing the same.

The object of the present disclosure is not limited to the objects mentioned above, and other objects not mentioned could be clearly understood by those skilled in the art to which the present disclosure pertains from the description below.

Technical Solution

In an aspect in the present disclosure, a method of manufacturing a steel plate for a cryogenic pressure vessel includes: reheating a slab containing, in weight %, C: 0.05 to 0.15%, Si: 0.20 to 0.35%, Mn: 0.5 to 1.5%, P: 0.012% or less, S: 0.015% or less, Al: 0.02 to 0.10%, Ni: 6.01 to 6.49%, Mo: 0.2 to 0.4%, Cr: 0.05 to 0.25%, and the balance being Fe and inevitable impurities; hot-rolling the reheated steel plate, followed by air cooling; subjecting the air-cooled steel plate to primary heat treatment at 800 to 880° C. for (2.4×t+(10 to 40)) minutes (t: slab thickness (mm)), followed by primary water cooling: subjecting the primarily water-cooled steel plate to secondary heat treatment at 700 to 780° C. for (2.4×t+(10 to 40)) minutes (t: slab thickness (mm)), followed by secondary water cooling: and tempering the secondarily water-cooled steel plate.

In another aspect in the present disclosure, a steel plate for a cryogenic pressure vessel includes: in weight %, C: 0.05 to 0.15%, Si: 0.20 to 0.35%, Mn: 0.5 to 1.5%, P: or less, S: 0.015% or less, Al: 0.02 to 0.10%, Ni: 6.01 to 6.49%, Mo: 0.2 to 0.4%, Cr: 0.05 to 0.25%, and the balance being Fe and inevitable impurities, in which the steel microstructure has a three-phase mixed structure of 1 to 9.5% of retained austenite, 40 to 80% of tempered bainite, and the balance being tempered martensite on a area fraction basis.

Advantageous Effects

According to a method for manufacturing a steel plate for a cryogenic pressure vessel of the present disclosure, by performing a process of heat-treating the air-cooled steel plate twice at a temperature of 800 to 880° C. and a temperature of 700 to 780° C. after hot rolling, it is possible to manufacture a steel plate for a cryogenic pressure vessel with a steel microstructure of a three-phase mixed structure of 1 to 9.5% of retained austenite, 40 to 80% of tempered bainite, and the balance being tempered martensite on an area fraction basis.

The steel plate for a cryogenic pressure vessel may have strength and lateral expansion characteristics that may be stably used at a cryogenic temperature of −150° C. or lower. Specifically, the steel plate for the cryogenic pressure vessel may have a yield strength of 610 MPa or more and a tensile strength of 750 MPa or more, and excellent cryogenic toughness characteristics of a Charpy impact energy of 190 J or more at −195° C.

In particular, the steel plate for a cryogenic pressure vessel is composed of a three-phase mixed structure of 1 to 9.5% of retained austenite, 40 to 80% of tempered bainite, and the balance being tempered martensite, and has excellent lateral expansion characteristics of 30% or more in elongation.

Best Mode

Hereinafter, a steel plate for pressure vessel with excellent cryogenic toughness and a method of manufacturing the same according to the present disclosure will be described in detail. The drawings to be provided below are provided by way of example so that the spirit of the present disclosure can be sufficiently transferred to those skilled in the art. Therefore, the present disclosure is not limited to the accompanying drawings provided below, but may be modified in many different forms. In addition, the accompanying drawings suggested below will be exaggerated in order to clear the spirit and scope of the present disclosure. Technical terms and scientific terms used in the present specification have the general meaning understood by those skilled in the art to which the present disclosure pertains unless otherwise defined, and a description for the known function and configuration unnecessarily obscuring the gist of the present disclosure will be omitted in the following description and the accompanying drawings.

Throughout the present specification, unless explicitly described to the contrary, "comprising" any components will be understood to imply the inclusion of other elements rather than the exclusion of any other elements.

According to an aspect of the present disclosure, a method of manufacturing a steel plate for a cryogenic pressure vessel includes: reheating a slab containing, in weight %, C: 0.05 to 0.15%, Si: 0.20 to 0.35%, Mn: 0.5 to 1.5%, P: 0.012% or less, S: 0.015% or less, Al: 0.02 to 0.10%, Ni: 6.01 to 6.49%, Mo: 0.2 to 0.4%, Cr: 0.05 to 0.25%, and the balance being Fe and inevitable impurities; hot-rolling the reheated steel plate, followed by air cooling; subjecting the air-cooled steel plate to primary heat treatment at 800 to 880° C. for (2.4×t+(10 to 40)) minutes (t: slab thickness (mm)), followed by primary water cooling: subjecting the primarily water-cooled steel plate to secondary heat treatment at 700 to 780° C. for (2.4×t+(10 to 40)) minutes (t: slab thickness (mm)), followed by secondary water cooling: and tempering the secondarily water-cooled steel plate.

As described above, according to the method for manufacturing a steel plate for a cryogenic pressure vessel of the present disclosure, by performing a process of heat-treating the air-cooled steel plate twice at a temperature of 800 to 880° C. and a temperature of 700 to 780° C. after hot rolling, it is possible to manufacture a steel plate for a cryogenic pressure vessel with a steel microstructure of a three-phase mixed structure of 1 to 9.5% of retained austenite, 40 to 80% of tempered bainite, and the balance being tempered martensite on an area fraction basis.

The steel plate for a cryogenic pressure vessel may have strength and lateral expansion characteristics that may be stably used at a cryogenic temperature of −150° C. or lower. Specifically, the steel plate for the cryogenic pressure vessel may have a yield strength of 610 MPa or more and a tensile strength of 750 MPa or more, and excellent cryogenic toughness characteristics of a Charpy impact energy of 190 J or more at −195° C.

In particular, the steel plate for a cryogenic pressure vessel is composed of a three-phase mixed structure of 1 to 9.5% of retained austenite, 40 to 80% of tempered bainite, and the balance being tempered martensite, and has excellent lateral expansion characteristics of 30% or more in elongation.

Hereinafter, the reason for limiting numerical values of alloy component content in an example of the present disclosure will be described. Hereinafter, unless otherwise specified, a unit is weight %.

In the steel plate for a cryogenic pressure vessel according to an embodiment of the present disclosure, the content of carbon (C) may be 0.05 to 0.15%. When the content of C is less than 0.05%, strength of a matrix itself is lowered, and when the content of C exceeds 0.15%, weldability of the steel plate is greatly impaired. A more preferred lower limit may be 0.07%, and a more preferred upper limit may be 0.13%.

In the steel plate for a cryogenic pressure vessel according to an embodiment of the present disclosure, the content of silicon (Si) may be 0.20 to 0.35%. Si is a component added for a deoxidation effect, a solid solution strengthening effect, and an impact transition temperature raising effect, and is preferably added 0.20% or more in order to achieve such an additive effect. However, when Si is added in excess of 0.35%, the weldability deteriorates and an oxide film is severely formed on a surface of the steel plate, and therefore, it is preferable to limit the content of Si to 0.20 to 0.35%. A more preferred lower limit may be 0.23%, and a more preferred upper limit may be 0.32%.

In the steel plate for a cryogenic pressure vessel according to an embodiment of the present disclosure, the content of manganese (Mn) may be 0.5 to 1.5%. Mn forms MnS, which is a non-metallic inclusion stretched together with S, to reduce room temperature elongation and low temperature toughness, and therefore, it is preferable that Mn is managed to be 1.5% or less. However, since it is difficult to secure adequate strength when Mn is less than 0.5% due to the nature of the components of the present disclosure, it is preferable to limit the added amount of Mn to 0.5 to 1.5%. A more preferred lower limit may be 0.52%, and a more preferred upper limit may be 1.2%.

In the steel plate for a cryogenic pressure vessel according to the embodiment of the present disclosure, the content of aluminum (Al) may be 0.02 to 0.10%. Al is one of the strong deoxidizers in the steelmaking process along with Si, and the effect is insignificant when the content of Al is less than 0.02%, and the manufacturing cost increases when Al is added at 0.10% or more, so it is preferable to limit the content of Al to 0.02 to 0.10%. A more preferred lower limit may be 0.025%, and a more preferred upper limit may be 0.09%.

In the steel plate for a cryogenic pressure vessel according to an example of the present disclosure, phosphorus (P) is an element that impairs low-temperature toughness, but excessive cost is required to remove the phosphorus (P) in the steelmaking process, so it is preferable to manage the phosphorus (P) within the range of 0.012% or less.

In the steel plate for cryogenic pressure vessels according to an example of the present disclosure, sulfur (S) is also an element that adversely affects low-temperature toughness along with P, but like P, excessive cost is required to remove the sulfur (S) in the steelmaking process, so it is preferable to manage the sulfur (S) within the range of 0.015% or less.

In the steel plate for a cryogenic pressure vessel according to the embodiment of the present disclosure, the content of nickel (Ni) may be 6.01 to 6.49%. Ni is the most effective element for improving low-temperature toughness. However, when Ni is added less than 6.01%, the reduction in the low-temperature toughness is caused, and when Ni is added in excess of 6.49%, the manufacturing cost increases, so it is preferable to add Ni within the range of 6.01 to 6.49%. A more preferred lower limit may be 6.08%, and a more preferred upper limit may be 6.45%.

In the steel plate for a cryogenic pressure vessel according to an example of the present disclosure, molybdenum (Mo) is a very important element for improving hardenability and strength, and the effect may not be expected when molybdenum (Mo) is added at less than 0.2% and is an expensive element, so it is preferable to limit the content of molybdenum (Mo) to 0.2 to 0.4%. More preferably, the content of molybdenum (Mo) may be 0.32% or less.

In the steel plate for a cryogenic pressure vessel according to an example of the present disclosure, chromium (Cr) is an important element capable of securing strength even at low and room temperatures. Since the addition of less than 0.05% of chromium (Cr) may not expect the effect and chromium (Cr) is an expensive element, it is preferable to limit the content of chromium (Cr) to 0.05 to 0.25%. A more preferable upper limit may be 0.22%.

The rest of the component is iron (Fe). However, since the unintended impurities from raw materials or the surrounding environment may inevitably be mixed in a normal manufacturing process, the unintended impurities may not be excluded. Since these impurities are known to those skilled in the ordinary manufacturing process, not all of them are specifically mentioned in this specification.

On the other hand, as described above, the steel plate for a cryogenic pressure vessel according to the present disclosure may be subjected to a heat treatment process twice to obtain a steel microstructure having a three-phase mixed structure of 1 to 9.5% of retained austenite, 40 to 80% of tempered bainite, and the retained tempered martensite. Accordingly, it is possible to secure a steel plate for a cryogenic pressure vessel with excellent strength and low-temperature toughness characteristics. On the other hand, when the area fraction of the tempered bainite is less than 40%, the amount of tempered martensite becomes excessive, and the low-temperature toughness of the steel plate may deteriorate, and it may be difficult to secure an elongation of 30% or more. On the other hand, when the area fraction of the tempered bainite exceeds 80%, it may be difficult to secure the target strength of the steel plate. In addition, when the area fraction of the retained austenite is less than 1.0%, the low-temperature toughness characteristics are impaired and it may be difficult to secure an elongation of 30% or more. Conversely, when the area fraction of the retained austenite exceeds 9.5%, the strength is reduced, so it is preferable to limit the area fraction of the retained austenite to the range of 1.0 to 9.5%.

In order to manufacture a steel plate for a cryogenic pressure vessel with a three-phase mixed structure satisfying such an area fraction, it is particularly important to undergo heat treatment processes twice after hot rolling and before tempering.

As described above, a method of manufacturing a steel plate for a cryogenic pressure vessel includes reheating a slab; hot-rolling the reheated steel plate, followed by air cooling; subjecting the air-cooled steel plate to primary heat treatment at 800 to 880° C. for (2.4×t+(10 to 40)) minutes (t: slab thickness (mm)), followed by primary water cooling; subjecting the primarily water-cooled steel plate to secondary heat treatment at 700 to 780° C. for (2.4×t+(10 to 40)) minutes (t: slab thickness (mm)), followed by secondary water cooling; and tempering the secondarily water-cooled steel plate.

First, the slab satisfying the above-described composition is prepared. The molten steel whose composition is adjusted to the above-described composition in the steelmaking process may be manufactured into a slab through continuous casting. The slab composition and content have been described above, and therefore, duplicate descriptions thereof will be omitted.

Thereafter, the prepared slab is reheated. By the reheating, the subsequent hot rolling process may be smoothly performed and the slab may be homogenized. The slab reheat temperature may be 1000 to 1200° C. When the reheating temperature is less than 1000° C., it is difficult to dissolve solute atoms, whereas, when the reheating temperature exceeds 1200° C., an austenite grain size becomes too coarse, which is not preferable because of impairing physical properties of the steel.

Thereafter, the heated slab is hot-rolled to manufacture the hot-rolled steel plate. Specifically, the hot rolling may be performed at a reduction ratio of 5 to 30% per pass, and rolling may be terminated at a temperature of 780° C. or higher.

When the reduction ratio per pass during the hot rolling is less than 5%, there is a problem in that manufacturing cost increases due to a decrease in rolling productivity. On the other hand, the reduction ratio exceeding 30% may cause a load on a rolling mill and have a fatal adverse effect on the equipment, which is not preferable. It is preferable to finish rolling at a temperature of 780° C. or higher. Rolling to a temperature of 780° C. or lower causes a load on the rolling mill, which is not preferable. The upper limit of the rolling end temperature is not particularly limited, but may be 900° C.

The hot-rolled steel plate after the hot rolling may be air-cooled. In this case, the air cooling method is not particularly limited, and it is sufficient if it is performed under conditions used in the art.

Thereafter, the air-cooled steel plate may be subjected to the primary heat treatment, and specifically, is heated at 800 to 880° C. for (2.4×t+(10 to 40)) minutes (t: slab thickness (mm)), followed by the primary water cooling. When the heat treatment temperature before the water cooling is less than 800° C., it is difficult to secure the target strength and elongation because austenitization is not performed, and when the heat treatment temperature exceeds 880° C., the grain size is too coarse and the toughness is impaired.

In the above-mentioned temperature range, when the holding time during the primary heat treatment is less than {(2.4×t)+10} minutes, it is difficult to homogenize the structure, whereas, when the holding time exceeds {(2.4×t)+40} minutes, productivity is impaired, which is not preferable.

On the other hand, the primary water cooling is performed at a temperature of 150° C. or lower, and when the water cooling temperature exceeds 150° C., the strength of the steel plate may decrease.

Thereafter, the water-cooled steel plate may be subjected to the secondary heat treatment, and specifically, is heated at 700 to 880° C. for (2.4×t+(10 to 40)) minutes (t: slab thickness (mm)), followed by the secondary water cooling. When the heat treatment temperature before the water cooling is less than 700° C., it is difficult to re-dissolve solid solute elements, so it is difficult to secure the target strength and elongation, whereas, when the temperature exceeds 780° C., there is a risk that crystal grain growth occurs to impair the low-temperature toughness.

In the above-mentioned temperature range, when the holding time during the secondary heat treatment is less than {(2.4×t)+10} minutes, it is difficult to homogenize the structure, whereas, when the holding time exceeds {(2.4×t)+40} minutes, productivity is impaired, which is not preferable.

On the other hand, the secondary water cooling is also performed at a temperature of 150° C. or lower, and when the water cooling temperature exceeds 150° C., the strength of the steel plate may decrease.

Next, the secondary water-cooled steel plate may be tempered, and specifically, tempered for {2.4×t+(10 to 40)} minutes [t: slab thickness (mm)] in a temperature range of 600 to 750° C. When the temperature during the tempering treatment is less than 600° C., it is difficult to secure the target strength due to the difficulty in precipitation of fine precipitates, whereas, when the temperature exceeds 750° C., there is a risk that the growth of precipitates may occur to impair the strength and low-temperature toughness.

In the above-mentioned temperature range, when the holding time during the tempering treatment is less than {(2.4×t)+10} minutes, it is difficult to homogenize the structure, whereas, when the holding time exceeds {(2.4×t)+40} minutes, productivity is impaired, which is not preferable.

Hereinafter, a steel plate for pressure vessel with excellent cryogenic toughness and a method of manufacturing the same according to the embodiment of the present disclosure will be described in more detail. However, the following Inventive Examples are only one reference example for describing the present disclosure in detail, and the present disclosure is not limited thereto and may be implemented in various forms.

In addition, unless otherwise defined, all technical and scientific terms have the same meaning as commonly understood by one of ordinary skill in the art to which this invention pertains. The terms used in the description herein are for the purpose of effectively describing particular embodiments only and are not intended to limit the invention. In addition, % unit of additives not specifically described in the specification is weight %, and 1 ppm is 0.0001 weight %.

Mode for Invention

Examples 1 to 6 and Comparative Examples 1 to 8

After preparing steel slabs satisfying the alloy composition and content shown in Table 1 below, these steel slabs were reheated at 1,100° C. for 2 hours. After hot rolling the reheated steel plate at a cumulative reduction ratio of 30%, the rolling was terminated at the temperature shown in Table 2, and air-cooled at room temperature.

The air-cooled plate was subjected to the primary heat treatment, the secondary heat treatment, and the tempering at the temperature and time shown in Table 2 below to obtain the steel plate for a cryogenic pressure vessel. In this case, after the primary heat treatment and the secondary heat treatment, the water cooling was performed at 150° C. or lower.

TABLE 1

| | Composition Component (wt %) | | | | | | | | |
|---|---|---|---|---|---|---|---|---|---|
| Steel Type | C | Mn | Si | P | S | Al | Ni | Mo | Cr |
| Inventive Steel a | 0.11 | 0.57 | 0.28 | 0.007 | 0.0012 | 0.031 | 6.19 | 0.29 | 0.15 |
| Inventive Steel b | 0.10 | 0.56 | 0.30 | 0.008 | 0.0010 | 0.032 | 6.25 | 0.28 | 0.12 |
| Inventive Steel c | 0.09 | 0.55 | 0.29 | 0.010 | 0.0015 | 0.029 | 6.20 | 0.30 | 0.10 |
| Comparative Steel d | 0.10 | 0.55 | 0.30 | 0.010 | 0.0010 | 0.030 | 6.25 | 0.25 | — |

TABLE 2

| | Steel Thickness | Hot rolling | Primary Heat Treatment | | Secondary Heat Treatment | | Tempering | |
|---|---|---|---|---|---|---|---|---|
| Division | (mm), Steel Type | and temperature (° C.) | Temperature (° C.) | Time (Minute) | Temperature (° C.) | Time (Minute) | Temperature (° C.) | Time (Minute) |
| Inventive Example 1 | 20 Steel Type a | 830 | 850 | 80 | 740 | 80 | 690 | 80 |
| Inventive Example 2 | | 850 | 860 | 80 | 730 | 80 | 680 | 80 |
| Inventive Example 3 | 35 Steel Type b | 870 | 850 | 105 | 750 | 105 | 670 | 105 |
| Inventive Example 4 | | 840 | 840 | 105 | 740 | 105 | 660 | 105 |
| Inventive Example 5 | 50 Steel Type c | 850 | 850 | 140 | 730 | 140 | 650 | 140 |
| Inventive Exemple 6 | | 870 | 860 | 140 | 740 | 140 | 660 | 140 |
| Comparative Example 1 | 25 Steel Type d | 850 | — | — | — | — | — | — |
| Comparative Example 2 | | 850 | — | — | — | — | — | — |
| Comparative Example 3 | 20 Steel Type a | 850 | 860 | 160 | — | — | 680 | 80 |
| Comparative Example 4 | | 850 | — | — | 730 | 160 | 680 | 80 |
| Comparative Example 5 | | 850 | 750 | 80 | 730 | 80 | 680 | 80 |
| Comparative Example 6 | | 850 | 900 | 80 | 730 | 80 | 680 | 80 |
| Comparative Example 7 | | 850 | 860 | 80 | 680 | 80 | 680 | 80 |
| Comparative Example 8 | | 850 | 860 | 80 | 800 | 80 | 680 | 80 |

The yield strength (YS, MPa), the tensile strength (TS, MPa), and the elongation (EL, %) tests were conducted on the prepared steel plates, and the low-temperature toughness was evaluated by the Charpy impact energy (Ec, J) value by performing a Charpy impact test on a specimen with a V notch at −195° C. The impact and tensile tests conformed to the standard ASTM A370 for the test piece, and the test method was performed according to ASTM E23 and ASTM E8, respectively.

TABLE 3

| | Microstructure | | | Mechanical Characteristics | | | |
|---|---|---|---|---|---|---|---|
| Division | TB fraction (%) | RO fraction (%) | TM fraction (%) | YS (MPa) | TS (MPa) | El (%) | $E_c$ (J) |
| Inventive Example 1 | 65 | 3.5 | 31.5 | 628 | 765 | 31 | 201 |
| Inventive Example 2 | 70 | 4.8 | 25.2 | 622 | 760 | 32 | 215 |
| Inventive Example 3 | 60 | 5.1 | 34.9 | 625 | 763 | 34 | 203 |
| Inventive Example 4 | 55 | 5.9 | 39.1 | 628 | 769 | 31 | 215 |
| Inventive Example 5 | 53 | 6.8 | 40.2 | 626 | 768 | 32 | 205 |
| Inventive Example 6 | 50 | 5.0 | 45 | 627 | 774 | 33 | 195 |
| Comparative Example 1 | 0 | 0 | 100 | 515 | 620 | 23 | 23 |
| Comparative Example 2 | 0 | 0 | 100 | 529 | 612 | 27 | 35 |
| Comparative Example 3 | 23 | 3.2 | 72.8 | 568 | 638 | 29 | 99 |
| Comparative Example 4 | 9 | 0 | 91 | 541 | 627 | 27 | 86 |
| Comparative Example 5 | 11 | 0 | 89 | 552 | 631 | 27 | 91 |
| Comparative Example 6 | 50 | 10.5 | 39.5 | 496 | 587 | 31 | 165 |
| Comparative Example 7 | 37 | 5.4 | 57.6 | 590 | 715 | 22 | 112 |
| Comparative Example 8 | 81 | 2.6 | 16.4 | 617 | 732 | 30 | 98 |

As shown in Tables 1 to 3, in the case of Inventive Examples 1 to 6 in which the steel composition components and the manufacturing process conditions satisfy the scope of the present disclosure, it was found that the steel microstructure after the tempering may include an area fraction of 1.0 to 9.5% of retained austenite (RO), and obtain the three-phase mixed structure of 40 to 80% of tempered bainite (TB) and the balance being tempered martensite (TM), so the yield strength and the tensile strength were about 100 MPa higher than Comparative Example, the elongation was improved by more than 5%, and the cryogenic impact energy at −195° C. also increased by more than 150 J.

On the other hand, when the primary heat treatment temperature or the secondary heat treatment temperature is different, as shown in Table 3, it was found that the area fraction of the microstructure is outside the range suggested in the present disclosure, and thus, it was confirmed that the strength is lowered or the elongation or low-temperature toughness characteristics were lowered.

As described above, although the present disclosure has been described by specific matters such as detailed components, exemplary embodiments, they have been provided only for assisting in the entire understanding of the present disclosure. Therefore, the present disclosure is not limited to the exemplary embodiments. Various modifications and changes may be made by those skilled in the art to which the present disclosure pertains from this description.

Therefore, the spirit of the present disclosure should not be limited to these exemplary embodiments, but the claims and all of modifications equal or equivalent to the claims are intended to fall within the scope and spirit of the present disclosure.

The invention claimed is:

1. A steel plate for a cryogenic pressure vessel, comprising:

in weight %, C: 0.05 to 0.15%, Si: 0.20 to 0.35%, Mn: 0.5 to 1.5%, P: 0.012% or less, S: 0.015% or less, Al: 0.02 to 0.10%, Ni: 6.01 to 6.49%, Mo: 0.2 to 0.4%, Cr: 0.05 to 0.25%, and the balance being Fe and inevitable impurities, wherein a microstructure of the steel has a three-phase mixed structure of 1 to 9.5% of retained austenite, 40 to 80% of tempered bainite, and the balance being tempered martensite on an area fraction basis.

2. A method of manufacturing a steel plate for a cryogenic pressure vessel according to claim 1 comprising:

reheating a slab containing, in weight %, C: 0.05 to 0.15%, Si: 0.20 to 0.35%, Mn: 0.5 to 1.5%, P: 0.012% or less, S: 0.015% or less, Al: 0.02 to 0.10%, Ni: 6.01 to 6.49%, Mo: 0.2 to 0.4%, Cr: 0.05 to 0.25%, and the balance being Fe and inevitable impurities;

hot-rolling the reheated steel plate, followed by air cooling;

subjecting the air-cooled steel plate to primary heat treatment at 800 to 880° C. for (2.4×t+(10 to 40)) minutes (t: slab thickness (mm)), followed by primary water cooling:

subjecting the primarily water-cooled steel plate to secondary heat treatment at 700 to 780° C. for (2.4×t+ (10 to 40)) minutes (t: slab thickness (mm)), followed by secondary water cooling; and tempering the secondarily water-cooled steel plate.

* * * * *